US012733745B2

(12) United States Patent
Kocakaplan

(10) Patent No.: US 12,733,745 B2
(45) Date of Patent: Sep. 15, 2026

(54) MATERNITY PILLOW

(71) Applicant: BABYMOOV GROUP, Clermont-Ferrand (FR)

(72) Inventor: Sermin Kocakaplan, Denizli (TR)

(73) Assignee: BABYMOOV GROUP, Clermont-Ferrand (FR)

( * ) Notice: Subject to any disclaimer, the term of this patent is extended or adjusted under 35 U.S.C. 154(b) by 51 days.

(21) Appl. No.: 18/996,314

(22) PCT Filed: Jul. 20, 2022

(86) PCT No.: PCT/FR2022/000066

§ 371 (c)(1),
(2) Date: Jan. 17, 2025

(87) PCT Pub. No.: WO2024/018120

PCT Pub. Date: Jan. 25, 2024

(65) Prior Publication Data

US 2026/0020684 A1 Jan. 22, 2026

(51) Int. Cl.
*A47C 20/02* (2006.01)
*A47D 13/08* (2006.01)

(52) U.S. Cl.
CPC ..... *A47C 20/025* (2013.01); *A47D 13/083* (2013.01)

(58) Field of Classification Search
CPC ..... A47C 20/025; A47D 13/083; A47G 9/10; A47G 9/1027; A47G 9/1045; A47G 2009/1018
See application file for complete search history.

(56) References Cited

U.S. PATENT DOCUMENTS 8,448,275 B1 * 5/2013 Leach ..... A47C 27/086 5/655
9,693,638 B1 * 7/2017 Leach ..... A47D 15/006
11,607,052 B1 * 3/2023 Gallegos ..... A47G 9/0253
(Continued)

FOREIGN PATENT DOCUMENTS

CA 2505699 A1 * 10/2006 ..... A47D 13/083
DE 202014003099 U1 * 7/2014 ..... A47G 9/1045
DE 202014004565 U1 * 7/2014 ..... A47G 9/1081
(Continued)

*Primary Examiner* — David E Sosnowski
(74) *Attorney, Agent, or Firm* — Thompson Coburn LLP; Steven M. Ritchey

(57) ABSTRACT

The invention relates to a maternity pillow comprising a shell and padding which is contained inside the shell. The shell has a first cover and a second cover which each delimit an internal volume and which are permanently attached to one another, the respective internal volumes of the first and second covers being in communication with each other such that the padding is movable in its entirety from one of the respective internal volumes of the first and second covers to the other in order to reversibly switch the maternity pillow between first and second use configurations. In the first use configuration, all of the padding and the second cover folded on itself are arranged in the internal volume of the first cover, giving the first cover an extended U shape. In the second use configuration, all the padding and the first cover in its folded condition are arranged in the internal volume of the second cover, the second cover thus being C-shaped in the unfolded condition.

10 Claims, 6 Drawing Sheets

(56) References Cited

U.S. PATENT DOCUMENTS

| | | | | |
|---|---|---|---|---|
| 2015/0040320 | A1* | 2/2015 | Gibbons | A47C 20/021 5/632 |
| 2023/0225528 | A1* | 7/2023 | Lee | A47C 20/025 5/652 |

FOREIGN PATENT DOCUMENTS

| | | | | | |
|---|---|---|---|---|---|
| KR | 20-2011-0010076 | U | | 10/2011 | |
| KR | 20110010076 | U | * | 10/2011 | A47C 3/16 |

* cited by examiner

MATERNITY PILLOW

CROSS-REFERENCE TO RELATED APPLICATIONS

This application is a U.S. National Phase application of PCT/FR2022/000066, filed on Jul. 20, 2022, which is incorporated herein by reference in its entirety.

The present invention relates to a maternity pillow.

Maternity pillows are used for a wide range of purposes by women who are pregnant and/or have recently given birth. Like any pillow, a maternity pillow comprises a shell, typically made of textile, and padding contained within the shell. Maternity pillows are unique in that their shape is curved in a U-shape, in other words in the shape of an elongated banana. This shape allows the maternity pillow to be used during pregnancy, in particular by unfolding the pillow along the body of the pregnant woman lying down, so that it can be used to support and thus relieve the weight of the pregnant woman's abdomen. Also during pregnancy, the maternity pillow can be used as a back support, so that the central area of the maternity pillow supports the lumbar region of the pregnant woman when she is sitting or lying down, while the arms of the maternity pillow form armrests for the pregnant woman. It is easy to see why this type of U-shaped maternity pillow is also commonly referred to as a "pregnancy pillow". After childbirth, the maternity pillow can be used to support part of the baby's weight during breastfeeding, the maternity pillow being placed both laterally and around the woman's abdomen, while at the same time at least partially supporting the body of the baby held by the woman. Of course, the maternity pillow can also be used in the same way by anyone feeding a baby.

That said, the U-shape of maternity pillows, which is very popular during pregnancy, is not always the most suitable for post-partum use, particularly for breastfeeding or bottle-feeding a baby due to the long length and relatively narrow thickness of the arms of the U-shaped maternity pillow. To address this problem, breastfeeding pillows are available that are more 'padded' than U-shaped maternity pillows. However, this increases the number of maternity products to be procured, which leads to problems of cost, storage, practicality, etc.

The aim of the present invention is to offer a new maternity pillow that is more practical, in particular by being more satisfactorily usable for multiple purposes.

To this end, the invention relates to a maternity pillow, as defined in claim 1.

The idea behind the invention is to combine two maternity pillows of different shapes, typically a pregnancy pillow and a nursing pillow, into a single maternity pillow. To achieve this, the shell of the maternity pillow in accordance with the invention incorporates two covers, which are integral with each other and whose respective internal volumes are in communication with each other so that the padding of the maternity pillow is movable in its entirety from one of these internal volumes to the other. A first of the two covers is designed, in particular by virtue of its dimensions, to unfold and stretch into a U shape when all the padding, together with the second cover folded on itself, are placed in the internal volume of the first cover: by giving the first cover this U shape, the maternity pillow can then typically be used as a pregnancy pillow, as mentioned in the introduction to this document. The second cover, for its part, is designed, particularly by virtue of its dimensions, to unfold and stretch into a C shape when all the padding and the first cover, folded on itself, are placed in the internal volume of the second cover: by giving the second cover this C shape, the maternity pillow can then be used in typical fashion as a breastfeeding/bottle-feeding pillow. In this way, the maternity pillow in accordance with the invention can be used in two distinct configurations in which its cover has two different shapes, namely a U-shape, given exclusively by the first cover when unfolded, and a C-shape, given exclusively by the second cover when unfolded. The practicality of the maternity pillow in accordance with the invention is therefore remarkable, as it can be switched at will from one of the two configurations to the other according to the user's needs. Switching between the two use configurations is simple and easy, as it requires nothing more than moving the padding from one of the respective internal volumes of the two covers to the other and folding the non-unfolded cover onto itself to place it inside the internal volume of the unfolded cover.

In practice, the maternity pillow in accordance with the invention advantageously has features, in particular of structure or shape, which further improve its performance, as detailed below. Thus, additional advantageous features of the maternity pillow in accordance with the invention, taken alone or in any technically possible combination, are set out in claims 2 and beyond.

The invention will be better understood upon reading the following description, given only as an example, and with reference to the drawings, in which:

FIGS. 1 to 6 depict a maternity pillow 1.

Figure 3:
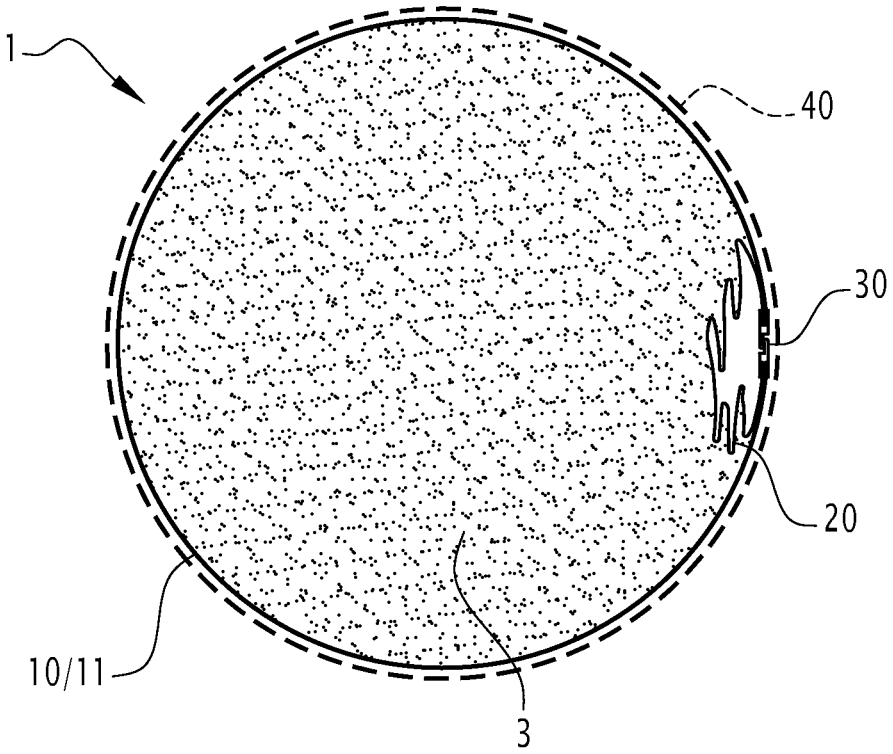
FIG. 3 is a schematic cross-section of line III-III of FIG. 2.

The maternity pillow 1 comprises a shell 2 and padding 3, which is only visible in FIG. 3 and is contained inside the shell 2.

Figure 1:
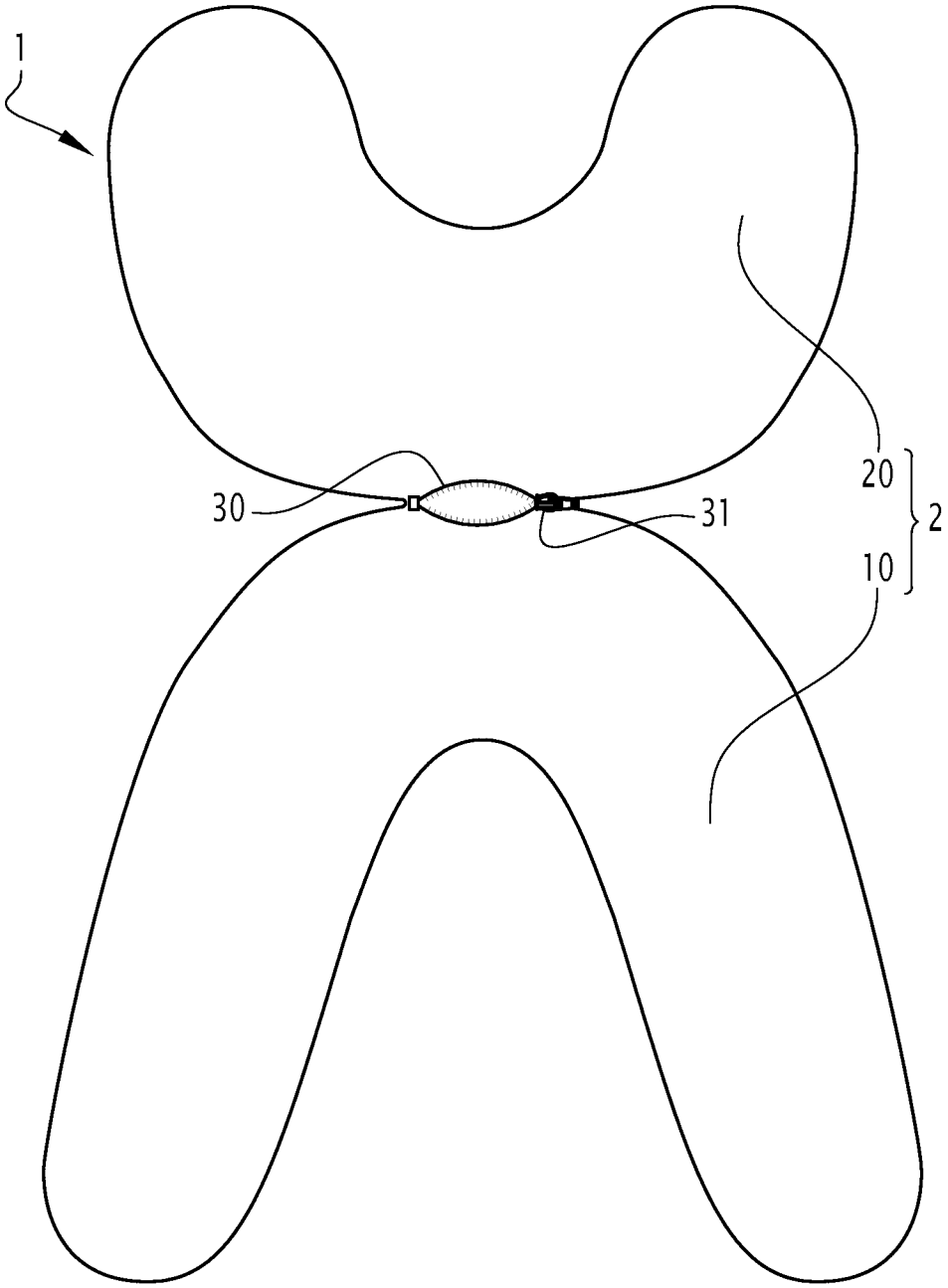
FIG. 1 is an elevation view of a maternity pillow in accordance with the invention, shown in a non-functional configuration.

As can be seen in FIG. 1, the shell 2 comprises, or as is the case here, consists of two covers, namely a cover 10 and a cover 20, which are separate from each other but which, as will be explained later, are permanently attached to each other.

Each of the covers 10 and 20 has its own internal volume. In this way, the cover 10 alone defines its internal volume and the cover 20 alone defines its internal volume, which is distinct from the internal volume of the cover 10. In practice, the covers 10 and 20 are flexible so that their internal volume is variable depending on the unfolded condition and padding of the cover in question. In particular, the internal volume of the cover 10 or cover 20 is smaller when the cover is folded on itself than when the cover is unfolded until it is taut. Preferably, the covers 10 and 20 are textile, for example made of cotton. The covers 10 and 20 are thus comfortable and easy to wash. To further improve their comfort, and to give them elasticity or stretch, the textile covers 10 and 20 are advantageously made of jersey. In any event, the covers 10 and 20 are preferably sewn together, but this is not limiting.

Figure 2:
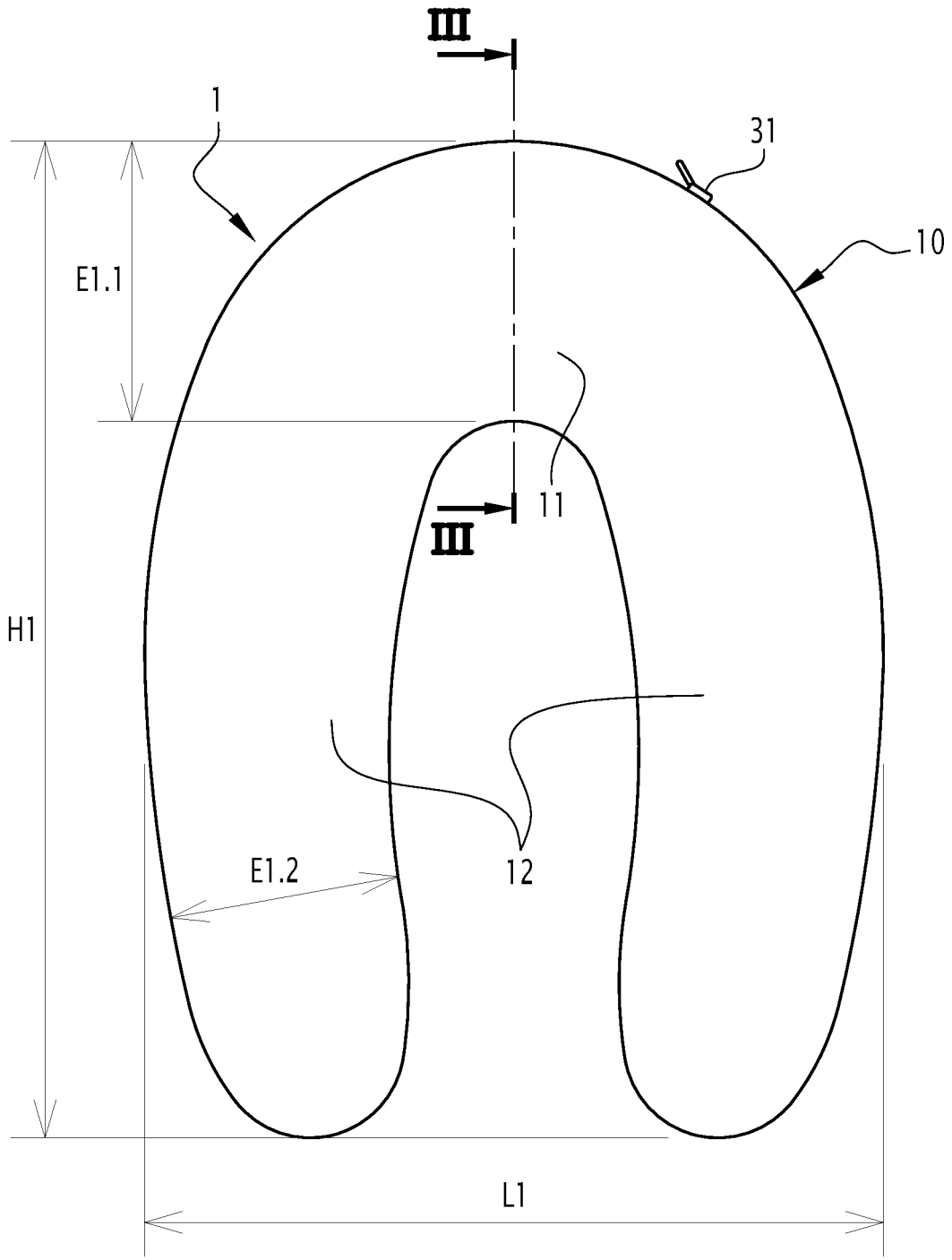
FIG. 2 is a view similar to FIG. 1, illustrating the maternity pillow of FIG. 1 in a first use configuration.
Figure 4:
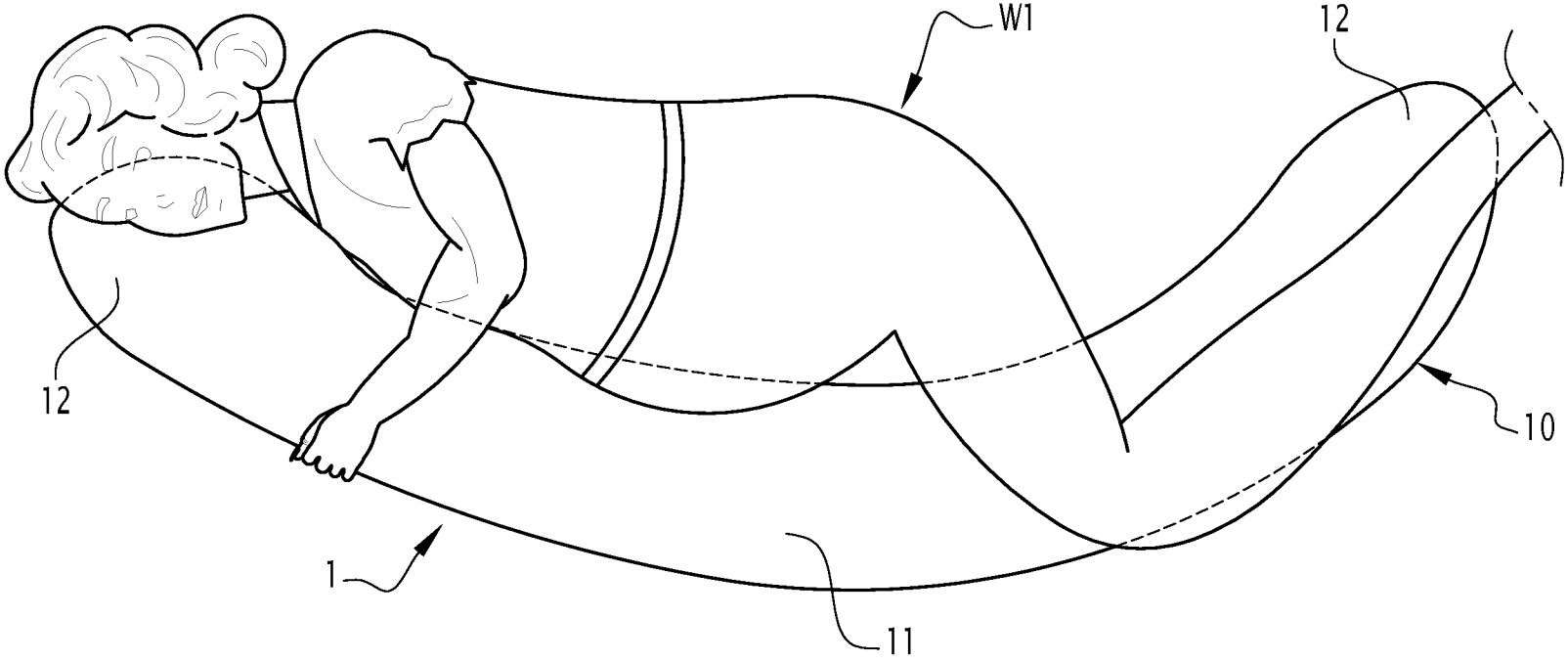
FIG. 4 is a perspective view illustrating an example use of the maternity pillow in its first use configuration.

The covers 10 and 20 are permanently attached together so that the respective internal volumes of covers 10 and 20 are in free communication with each other. In other words, in the assembled state of the shell 2, the internal volume of the cover 10 communicates freely with the internal volume of the cover 20, the communication between the respective internal volumes of the covers 10 and 20 taking place at a junction between the two covers 10 and 20 where the latter are permanently attached to one another. In addition, the padding 3 is housed in the internal volumes of the covers 10 and 20, while being movable from one to the other of these internal volumes via the communication junction between these internal volumes. Depending on the distribution of the padding 3 between the insides of the covers 10 and 20 and on the relative arrangement of the covers 10 and 20, the maternity pillow 1 has different configurations which will be detailed successively below, namely a first use configuration, which is illustrated in FIGS. 2 to 4, a second use configuration, which is illustrated in FIGS. 5 and 6, and a non-functional configuration, which is illustrated in FIG. 1.

In the first use configuration of the maternity pillow 1, the cover 20 is folded on itself and is arranged, along with the entire padding 3, in the internal volume of the cover 10. The presence, in the internal volume of the cover 10, of all the padding 3 and the cover 20 folded on itself tightens the cover 10, which is sized accordingly, and gives it a U-shaped, i.e. kielbasa, unfolded shape, the profile of which is U-shaped, as clearly visible in FIG. 2, and the cross-section of which is curved, or even substantially circular, as clearly visible in FIG. 3. Of course, this U shape is presented by the cover 10 when the latter is at rest, i.e. when the cover 10 is not deformed by forces external to the maternity pillow 1, applied to the cover 10. As can be clearly seen in FIG. 2, the cover 10 is then shaped with a central region 11, with a curved profile, and two arms 12 which extend from the central region 11 generally parallel to each other. The cover 10 then has a length, i.e. a maximum dimension in a direction perpendicular to the longitudinal direction of the arms 12, which is marked L1 in FIG. 2, and a height, i.e. a maximum dimension in the longitudinal direction of the arms 12, which is marked L2 in FIG. 2. The central region 11 of the cover 10 then has a thickness, i.e. a transverse dimension, which is marked E1.1 in FIG. 2. Each of the arms 12 of the cover 10 then has a thickness, i.e. a transverse dimension, which is marked E1.2 in FIG. 2.

In the first use configuration, the maternity pillow 1 can be used in a variety of ways. FIG. 4 illustrates an example use, in which a pregnant woman W1 who is lying on her side uses the maternity pillow 1 by moving the arms 12 of the cover 10 away from each other to position the central region 11 of the cover 10 against a side of her stomach and thus support it, while one of the arms 12 is positioned along the upper part of her body, if necessary as far as her head, which can then rest against this arm 12, and the other arm 12 is positioned between her folded legs. Other examples of use of the maternity pillow 1 in the first use configuration are conceivable, in all cases taking advantage of the U shape of the cover 10.

Figure 5:
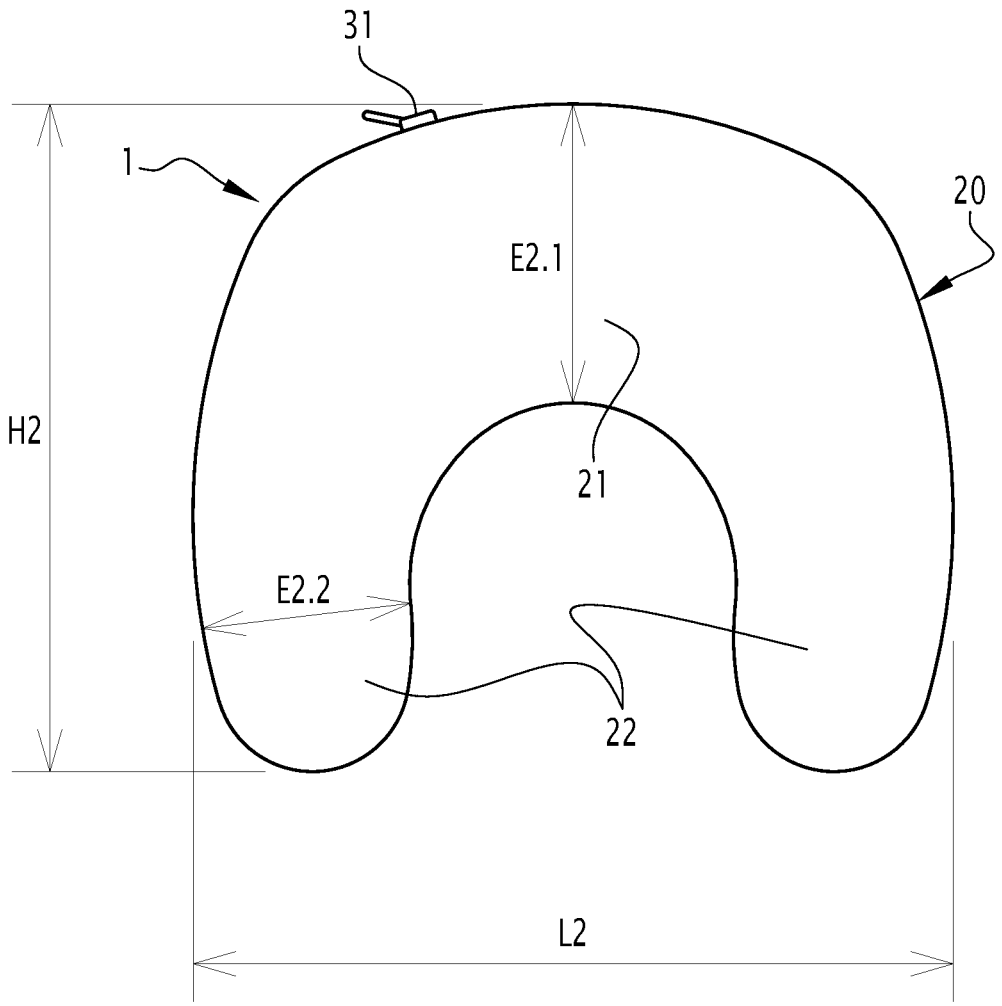
FIG. 5 is a view similar to FIG. 2, illustrating the maternity pillow of FIG. 1 in a second use configuration.
Figure 6:
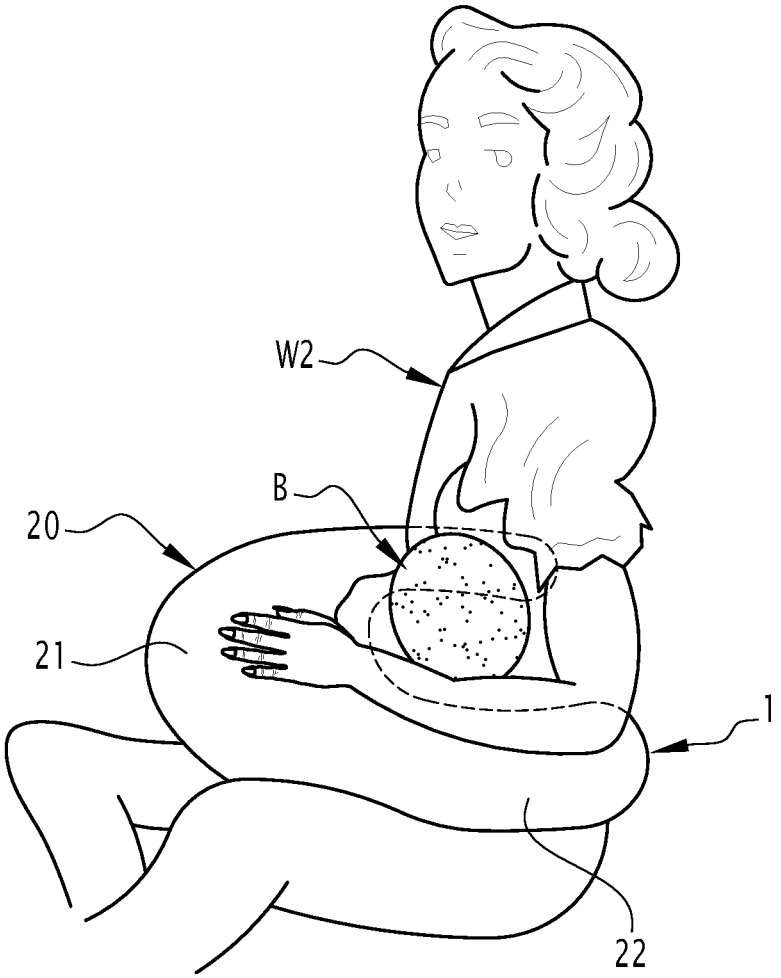
FIG. 6 The figure is a view similar to FIG. 4, illustrating an example use of the maternity pillow in its second use configuration.

In the second use configuration of the maternity pillow 6 which is shown in FIGS. 5 and 6, the cover 10 is folded on itself and is arranged, along with the entire padding 3, inside the internal volume of the cover 20. The presence, in the internal volume of the cover 20, of all the padding 3 and the cover 10 folded in on itself stretches the cover 20, which is sized accordingly, and gives it a unfolded C shape, i.e. a kielbasa shape, the profile of which is C-shaped, as clearly visible in FIG. 5, and the cross-section of which is curved, or even substantially circular, as is the case for the cross-section of the kielbasa shape of the cover 10 when the maternity pillow 1 is in the first use configuration. Of course, following similar considerations to those indicated above for the cover 10 when the maternity pillow 1 is in the first use configuration, the C shape that the cover 20 has when the maternity pillow 1 is in the second use configuration is effective when the cover 20 is at rest. As can be clearly seen in FIG. 5, the cover 20 is then shaped with a central region 21, with a curved profile, and two arms 22 which extend from the central region 21 generally parallel to each other. Following similar considerations to those concerning the length L1, the height H1 and the thicknesses E1.1 and E1.2 of the cover 10 when the maternity pillow 1 is in the first use configuration, the cover 20 has, at rest, in the second use configuration of the maternity pillow 1, a length L2 and a height H2 while its central region 21 has a thickness E2.1 and each of its arms 22 has a thickness E2.2, as shown in FIG. 5.

In the second use configuration, the maternity pillow 1 is usable in a variety of ways. FIG. 6 illustrates an example use in which a woman W2, in a seated position and breastfeeding a baby B, uses the maternity pillow 1 to partially encircle her abdomen so that the arms 22 of the cover 20 are arranged respectively to the left and right of the torso of the woman W2 and the central region 21 is arranged in front of the torso of the woman W2: the baby B, who is breastfeeding, rests its head on one or other of the arms 12 of the cover 20, supported if need be by one of the arms of the woman W2. Other examples of use of the maternity pillow 1 in the second use configuration are conceivable, which take advantage of the C shape of the cover 20.

By definition, the C shape of the cover 20 when the maternity pillow 1 is in the second use configuration is geometrically different from the U shape of the cover 10 when the maternity pillow 1 is in the first use configuration, in that although this C shape and this U shape are both similar to a banana shape, the arms 22 of the cover 20 when the maternity pillow 1 is in the second use configuration are shorter than the arms 12 of the cover 10 when the maternity pillow 1 is in the first use configuration. The maternity pillow 1 in the second use configuration is therefore easier to handle than the maternity pillow 1 in the first use configuration, and vice versa. For example, it is more practical for the arms 22 of the cover 20 when the maternity pillow 1 is in the second configuration to be relatively short for the purpose of cradling the baby who is breast-feeding in the example use shown in FIG. 6, compared to the arms 12 of the cover 10 of the maternity pillow 1 in the first use configuration for the purpose of cradling the abdomen of the pregnant woman W1 in the example use shown in FIG. 4.

According to a preferred sizing, which reinforces the distinctiveness of use between the maternity pillow 1 in the first use configuration and the maternity pillow 1 in the second use configuration, the aforementioned length L1 and height H1 are respectively greater than the aforementioned length L2 and height H2, while the aforementioned thicknesses E1.1 and E1.2 are respectively smaller than the aforementioned thicknesses E2.2 and E2.2.

It should also be noted that the padding of the cover 10 when the maternity pillow 1 is in the first use configuration consists mainly of the entire padding 3 and, marginally, of the cover 20 folded on itself, whereas the padding of the cover 20 when the maternity pillow 1 is in the second use configuration consists mainly of all the padding 3 and, marginally, of the cover 10 folded on itself: these two paddings are therefore virtually identical. It is therefore understood that the firmness of the maternity pillow 1 depends directly on the value of the internal volume of the cover 10 at rest when the maternity pillow is in the first configuration and directly on the value of the internal volume of the cover 20 at rest when the maternity pillow 1 is in the second use configuration. Thus, by providing that the two aforementioned values are substantially equal to each other, typically within less than 10%, the maternity pillow 1 has a similar firmness in the first configuration and in the second use configuration. Alternatively, by providing that the value of the internal volume of the cover 10 when the maternity pillow 1 is in the first use configuration is at least 10% greater than the value of the internal volume of the cover 20 when the maternity pillow 1 is in the second configuration, the maternity pillow 1 feels firmer in its second use configuration than in its first use configuration.

In the non-functional configuration shown in FIG. 1, the cover 10 is unfolded outside the internal volume of the cover 20, which is itself unfolded outside the internal volume of the cover 10. The padding 3 is distributed equally between the respective internal volumes of the covers 10 and 20, and can be moved in its entirety from one of these internal volumes to the other. This non-functional configuration of FIG. 1 illustrates how the maternity pillow 1 can be reversibly moved between the first use configuration and the second use configuration, by moving all of the padding 3 from one of the respective internal volumes of the covers 10 and 20 to the other.

According to a preferred arrangement, which is illustrated in the figures and which is particularly practical for use of the maternity pillow 1, the covers 10 and 20 are connected to each other by a zip fastener 30 of the maternity pillow 1, such as a zipper (registered trademark). In practice, this zip fastener 30 has edges which can be moved apart when the zip fastener 30 is open and which are joined together when the zip fastener 30 is closed. These edges of the zip fastener 30 are each attached to the cover 10 and the cover 20, typically by stitching, at the junction between the covers 10 and 20 where they are permanently attached to each other. When the zip fastener 30 is open, as in FIG. 1, it allows the maternity pillow 1 to pass between the first and second use configurations. When the zip fastener 30 is closed while the maternity pillow 1 is in the first use configuration, as in FIGS. 2 to 4, the zip fastener 30 closes the internal volume of the cover 10. When the zip fastener 30 is closed while the maternity pillow 1 is in the second use configuration, as in FIGS. 5 and 6, the zip fastener 30 closes the internal volume of the cover 20. In order to control the opening and closing of the zip fastener 30, the latter is provided with a slider 31 which is reversible, i.e. a pull tab of which is designed to pass freely between the two opposite sides of the zip fastener 30: in this way, the pull tab of the slider 31 can be positioned on the side of the zip fastener 30 facing the outside of the cover 10 when the maternity pillow 1 is in the first use configuration and can be positioned on the side of the zip fastener 30 facing the outside of the cover 10 when the maternity pillow 1 is in the second use configuration, so that the pull tab can always be easily grasped by the user.

Preferably, the padding 3 consists of microbeads, for example made of polystyrene or corn. The padding 3 is therefore particularly light and malleable, while being particularly easy to move by transferring from one to the other of the respective internal volumes of the covers 10 and 20 when the maternity pillow moves between the first and second use configurations.

Taking into account the explanations given so far, it is understood that the maternity pillow 1 has the advantage of being usable for various purposes in each of the first and second use configurations, while being able to be reversibly switched from one to the other of these two configurations. Furthermore, switching the maternity pillow 1 from one of the first and second configurations to the other is quick and easy. For example, to switch the maternity pillow 1 from the first to the second use configuration, the cover 20 is pulled out of the internal volume of the cover 10, possibly after opening the zip fastener 30. The padding 3 is then moved from the internal volume of the cover 10 to the internal volume of the cover 20. In practice, this movement of the padding 3 is advantageously carried out under the effect of gravity, being considerably facilitated by decanting when the padding 3 is made up of the aforementioned microbeads. The maternity pillow 1 then has an intermediate configuration between the first and second use configurations, which is similar to the non-functional configuration shown in FIG. 1. Once all the padding 3 has been placed in the internal volume of the cover 20, the cover 10 is folded on itself and placed in the internal volume of the cover 20. The maternity pillow 1 is then in the second use configuration, potentially after closing the zip fastener 30. Of course, in order to switch the maternity pillow 1 from the second use configuration to the first use configuration, the operations described above are reversed.

Finally, there are a number of possible developments and variants to the maternity pillow as described so far. For example:

- the maternity pillow 1 may comprise two outer covers which are distinct and separate from each other, a first of these two outer covers being designed to be removably attached to the cover 10 when the maternity pillow 1 is in the first use configuration, covering this cover 10 in a fitted manner, while the second outer cover is designed to be removably attached to the cover 20 when the maternity pillow 1 is in the second use configuration, covering this cover 10 in a fitted manner; the first outer cover is shown in dotted lines only in FIG. 3, as reference 40; these outer covers make it possible, in particular, to improve hygiene, as they are designed to be washable, and to alter the appearance of the maternity pillow;
- instead of the zip fastener 30, other means of fastening can be envisaged to connect the respective internal volumes of the covers 10 and 20 to each other,
- instead of being made up of microbeads, the padding 3 may comprise one or more other materials, such as batting; and/or
- in order to be able to periodically refill the padding 3, at least one of the covers 10 and 20 is advantageously provided with a sealable opening through which additional padding can be introduced into the internal volume of the cover in question.

The invention claimed is:

1. A maternity pillow comprising a shell and padding, which is contained inside the shell, wherein the shell comprises a first cover and a second cover, each of which delimit a respective internal volume and are permanently attached to one another, the respective internal volumes of the first and second covers being in communication with each other such that the padding is movable in its entirety from one of the respective internal volumes of the first and second covers to the other in order to reversibly switch the maternity pillow between the following:

- a first use configuration, wherein all the padding and the second cover folded on itself are arranged in the internal volume of the first cover, giving the first cover a U shape when unfolded; and a second use configuration, wherein all the padding and the first cover folded on itself are arranged in the internal volume of the second cover, giving the second cover a C shape when unfolded.

2. The maternity pillow according to claim 1, wherein the respective internal volumes of the first and second covers are connected to each other by a zip fastener that:

allows the maternity pillow to switch between the first and second use configurations when the zip fastener is open;

closes the internal volume of the first cover when the zip fastener is closed while the maternity pillow is in the first use configuration;

closes the internal volume of the second cover when the zip fastener is closed while the maternity pillow is in the second use configuration; and is fitted with a reversible opening/closing control slider.

3. The maternity pillow according to claim 1, wherein:

the first cover, when the maternity pillow is in the first use configuration, and the second cover, when the maternity pillow is in the second use configuration, have a first length and a second length, respectively, the first length being greater than the second length;

the first cover, when the maternity pillow is in the first use configuration, and the second cover, when the maternity pillow is in the second use configuration, have a first height and a second height, respectively, the first height being greater than the second height;

a central region of the first cover, when the maternity pillow is in the first use configuration, and a central region of the second cover, when the maternity pillow is in the second use configuration, have a first thickness and a second thickness, respectively, the first thickness being smaller than the second thickness; and each of the two arms of the first cover, when the maternity pillow is in the first use configuration, and each of the two arms of the second cover, when the maternity pillow is in the second configuration, have a third thickness and a fourth thickness, respectively, the third thickness being smaller than the fourth thickness.

4. The maternity pillow according to claim 1, wherein the internal volume of the first cover, when the maternity pillow is in the first use configuration, has a value which is substantially equal to that of the internal volume of the second cover, when the maternity pillow is in the second use configuration.

5. The maternity pillow according to claim 1, wherein the internal volume of the first cover, when the maternity pillow is in the first use configuration, has a value which is at least 10% greater than the internal volume of the second cover, when the maternity pillow is in the second use configuration.

6. The maternity pillow according to preceding claim 1, wherein the padding consists of microbeads.

7. The maternity pillow according to claim 1, wherein the first and second covers are textile.

8. The maternity pillow according to claim 7, wherein the textile is a jersey fabric.

9. The maternity pillow according to claim 1, wherein the first and second covers are stitched together.

10. The maternity pillow according to claim 1, wherein the maternity pillow further comprises:

a first outer cover, which is adapted to be removably attached to the first cover when the maternity pillow is in the first use configuration, covering the first cover in a fitted manner; and a second outer cover, which is distinct and separate from the first outer cover and is adapted to be removably attached to the second cover when the maternity pillow is in the second use configuration, covering the second cover in a fitted manner.

* * * * *